US007038227B2

(12) United States Patent
Aust

(10) Patent No.: US 7,038,227 B2
(45) Date of Patent: May 2, 2006

(54) INFRARED EMITTER EMBODIED AS A PLANAR EMITTER

(75) Inventor: Richard Aust, Mönchengladbach (DE)

(73) Assignee: Voith Paper Patent GmbH, Heidenheim (DE)

( * ) Notice: Subject to any disclaimer, the term of this patent is extended or adjusted under 35 U.S.C. 154(b) by 92 days.

(21) Appl. No.: 10/917,185

(22) Filed: Aug. 11, 2004

(65) Prior Publication Data

US 2005/0017203 A1 Jan. 27, 2005

Related U.S. Application Data

(63) Continuation of application No. PCT/DE03/00387, filed on Feb. 11, 2003.

(30) Foreign Application Priority Data

Feb. 12, 2002 (DE) ..... 102 05 922
May 22, 2002 (DE) ..... 102 22 450

(51) Int. Cl.
*G01J 5/02* (2006.01)

(52) U.S. Cl. ..... 250/493.1; 250/495.1; 250/504 R

(58) Field of Classification Search ..... 250/493.1, 250/494.1, 495.1, 504 R
See application file for complete search history.

(56) References Cited

U.S. PATENT DOCUMENTS

| | | | | |
|---|---|---|---|---|
| 3,661,499 | A | 5/1972 | Krieger | |
| 4,814,581 | A | 3/1989 | Nunogaki et al. | |
| 4,876,586 | A * | 10/1989 | Dyck et al. | 257/451 |
| 5,989,013 | A | 11/1999 | Gray | |
| 6,008,479 | A | 12/1999 | Jiang et al. | |
| 6,049,065 | A | 4/2000 | Konishi | |
| 6,211,496 | B1 | 4/2001 | Uchiyama et al. | |
| 6,575,736 | B1 | 6/2003 | Aust et al. | |

FOREIGN PATENT DOCUMENTS

| | | |
|---|---|---|
| DE | 464692 | 8/1928 |
| DE | 1218375 | 7/1966 |
| DE | 1233764 | 8/1967 |
| DE | 1629952 | 2/1972 |
| EP | 0221686 | 10/1986 |
| FR | 1595547 | 3/1968 |
| FR | 2683022 | 10/1991 |
| WO | WO 00/42356 | 12/1999 |
| WO | WO 03/006880 | 1/2003 |

* cited by examiner

*Primary Examiner*—Kiet T. Nguyen
(74) *Attorney, Agent, or Firm*—Taylor & Aust, P.C.

(57) ABSTRACT

A radiant element which is heated on its rear side by a burning fluid-air mixture and whose front side emits the infrared radiation. The radiant element is produced from a highly heat resistant material which contains more than 50% by weight of a metal silicide, preferably molybdenum disilicide ($MoSi_2$) or tungsten disilicide ($WSi_2$).

21 Claims, 7 Drawing Sheets

INFRARED EMITTER EMBODIED AS A PLANAR EMITTER

CROSS REFERENCE TO RELATED APPLICATIONS

This is a continuation of PCT application No. PCT/DE03/00387, entitled "INFRA-RED EMITTER EMBODIED AS A PLANAR EMITTER", filed Feb. 11, 2003.

BACKGROUND OF THE INVENTION

1. Field of the Invention

The present invention relates to an infrared emitter, and, more particularly to an infrared emitter embodied as a planar emitter.

2. Description of the Related Art

Infrared emitters embodied as planar emitters are used in dryer systems which are used to dry web materials, for example paper or board webs. Depending on the width of the web to be dried and the desired heating output, the requisite number of emitters are assembled with aligned emission surfaces to form a drying unit.

The basic structure of a single generic infrared emitter is illustrated in FIG. 16 and described, for example, in DE 199 01 145-A1.

The fuel/air mixture needed for the operation of the emitter is supplied to the emitter through an opening (a) in the housing (b) and firstly passes into a distribution chamber (c), in which the mixture is distributed uniformly over the emitter surface, at right angles to the view shown here. The gases then pass through a barrier (d) which is configured so as to be permeable. The main task of the barrier (d) is to isolate the combustion chamber (e), in which the gas is burned, from the distribution chamber (c), in which the unburned gas mixture is located, in such a way that no flashback from the combustion chamber (e) to the distribution chamber (c) can take place. In addition, the barrier (d) should expediently be designed such that the best possible heat transfer from the hot combustion waste gases to the solid element that emits the radiation, that is to say the surface of the barrier (d) itself or possibly the walls of the combustion chamber (e) and the actual radiant element (f) is prepared. The geometric/constructional configuration of combustion chamber (e) and radiant element (f) is likewise carried out from the following points of view:

optimized heat transfer, maximized heat emission, minimum heat losses to the side and in the direction of the distribution chamber, taking into account thermal expansion which occurs and application specific special features, such as possible contamination, thermal shock which occurs, and so on.

What is needed in the art is an improved construction that increases the lifetime of the emitter.

SUMMARY OF THE INVENTION

The present invention maximizes the lifetime of a construction of an emitter by using a particularly suitable material for the radiant element, since the latter as a rule represents the wearing part of the construction.

The invention comprises, in one form thereof, a radiant element which is heated on its rear side by a burning fluid-air mixture and whose front side emits the infrared radiation. The radiant element is produced from a highly heat resistant material which contains more than 50% by weight of a metal silicide, preferably molybdenum disilicide ($MoSi_2$) or tungsten disilicide ($WSi_2$).

An infrared emitter according to the present invention may be operated for a very high specific heat output with flame temperatures of more than 1200° C., if necessary even more than 1700° C. In this case, the radiant element has a high emission factor and a long service life. Added to this is the further advantage that the material can be provided in various forms in order to optimize the emission behavior and the convective heat transfer.

The dependent claims contain refinements of an infrared emitter according to the present invention which are preferred, since they are particularly advantageous.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
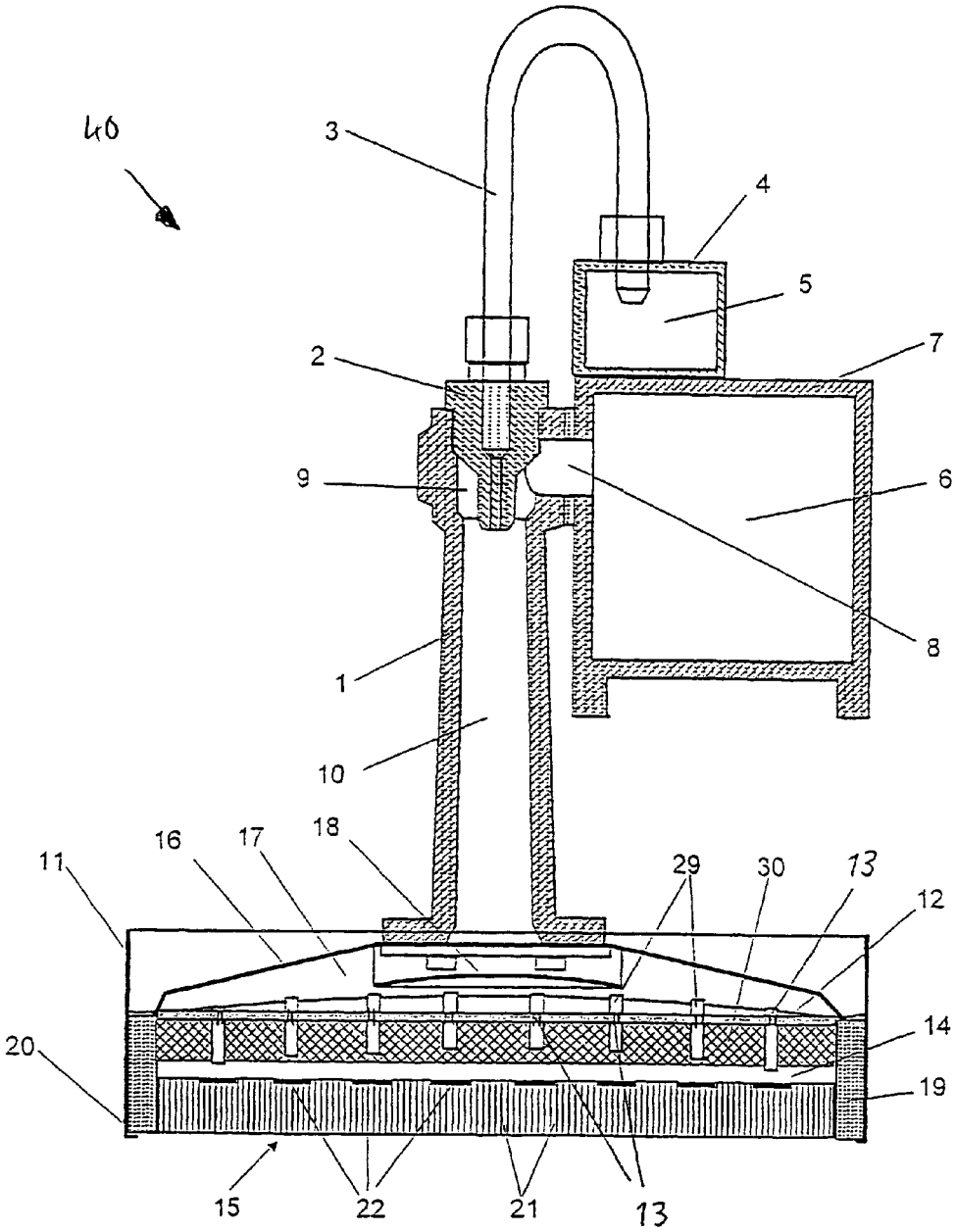
FIG. 1 is a cross-sectional view through a structure of an infrared emitter according to the present invention.

Referring now to the drawings, and, more particularly to FIG. 1, there is shown emitter 40 which contains a mixing pipe 1, into which a mixing jet 2 is screwed at one end. Connected to mixing jet 2 is a gas supply line 3, which is connected to a manifold line 4, from which a plurality of emitters arranged beside one another are supplied with gas 5. The supply with air 6 is provided via a hollow cross member 7, to which mixing pipe 1 is fixed. A connecting line 8 for the air supply opens in the upper part of mixing pipe 1 into an air chamber 9 which is open at the bottom and surrounds the outlet end of mixing jet 2, so that a gas-air mixture is introduced into mixing chamber 10 of mixing pipe 1 from above.

The infrared emitters according to the present invention are preferably heated with gas; alternatively, heating with a liquid fuel such as a heating fluid is possible.

Fixed at the lower, open end of mixing pipe 1 is a housing 11, in which a ceramic burner plate 12 is arranged as a barrier. Burner plate 12 contains a series of continuous holes 13, which open into a combustion chamber 14, which is formed between burner plate 12 and a radiant element 15 arranged substantially parallel to and at a distance from the latter. In combustion chamber 14, flames are formed, which heat radiant element 15 from the rear, so that the latter emits infrared radiation.

For the supply of the gas-air mixture, mixing pipe 1 opens into a distribution chamber 17, which is sealed off by a hood 16 and is connected to the other end of burner plate 12. In order that the gas-air mixture is distributed uniformly on the rear of burner plate 12, a baffle plate 18, against which the mixture supplied flows, is arranged in distribution chamber 17. Burner plate 12 is fitted in housing 11 in peripheral, fireproof seals 19. Radiant element 15 hangs in a peripheral fireproof frame 20, which is fixed to housing 11 and, together with seals 19, terminates combustion chamber 14 in a gastight manner at the sides.

Radiant element 15 is fabricated from a highly heat-resistant material which contains more than 50% by weight of a metal silicide as its main constituent. The metal silicides used are preferably molybdenum disilicide ($MoSi_2$) or tungsten disilicide ($WSi_2$). Silicon oxide ($SiO_2$), zirconium oxide ($ZrO_2$) or silicon carbide (SiC) or mixtures of these compounds are preferably contained as further constituents. These materials are extremely temperature resistant and stable, so that the emitter, if necessary, can be operated with flame temperatures of more than 1700° C. up to 1850° C. As compared with a likewise high temperature resistant alloy which includes exclusively of metals (for example a metallic heat conductor alloy), the material has the further advantage that no scaling occurs. In order to obtain an extremely long service life of the emitter, this can be operated with a flame temperature somewhat below the maximum possible temperature of radiant element 15; for example between 1100° C. and 1400° C., by which the formation of thermal $NO_x$ is kept within tolerable bounds.

Figure 2:
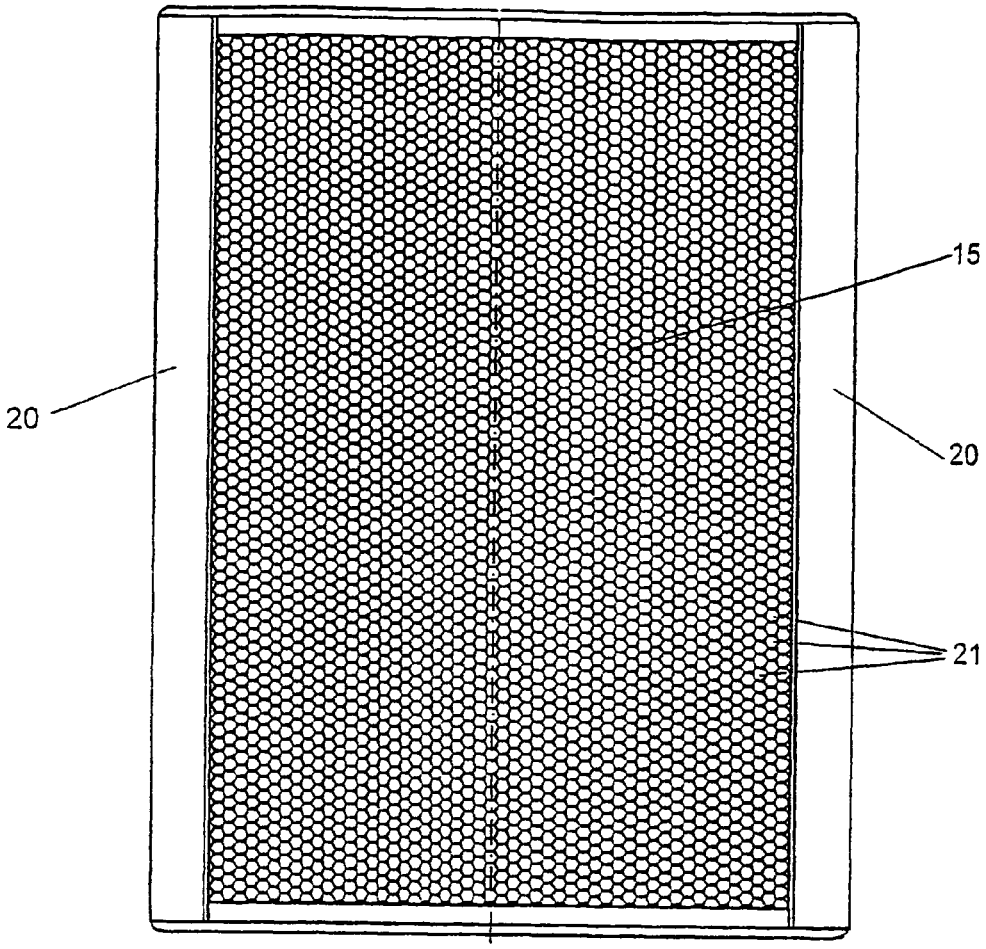
FIG. 2 is a plan view of the emitting front side of the radiant element according to FIG. 1.

In the embodiment according to FIGS. 1 and 2, radiant element 15 includes of a block which contains a large number of continuous ducts 21. Ducts 21 are heated on the rear side of radiant element 15 bounding combustion chamber 14. Ducts 21 are either tubular or slot-like. The cross-section of the tubular ducts is preferably either circular or in the form of a regular polygon. In the embodiment according to FIG. 2, ducts 21 are arranged beside one another in the form of a honeycomb. Alternatively, ducts 21 can also be formed in the manner of slots. For this purpose, radiant element 15 is preferably built up from a row of plates arranged at a distance from one another, whose interspaces form the slot-like ducts.

Figure 3:
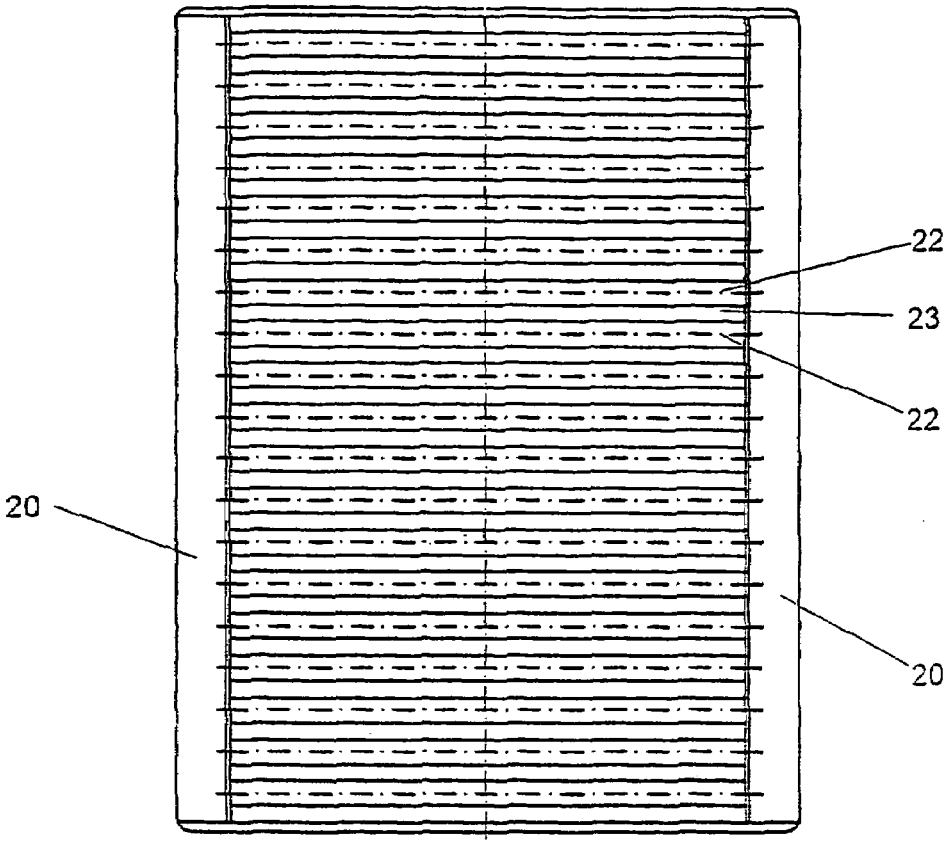
FIG. 3 is a plan view of a radiant element which is built up from individual tubes according to the present invention.
Figure 4:
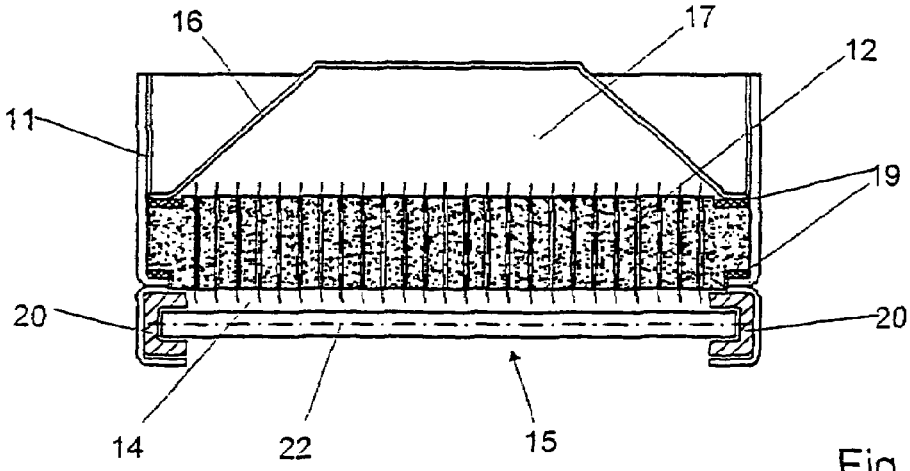
FIG. 4 is a cross-sectional view through the emitter having the radiant element according to FIG. 3.

FIGS. 3 and 4 illustrate an embodiment in which radiant element 15 is built up from a plurality of tubes 22 or rods arranged at a distance from one another. Tubes 22 or rods extend parallel to burner plate 14 and are fixed with their ends in each case in frame 20. The outer side of tubes 22 form the emitting front surface; in each case between two tubes 22 a gap-like opening 23 is formed, through which hot combustion waste gases and also infrared radiation can emerge.

Figure 5:
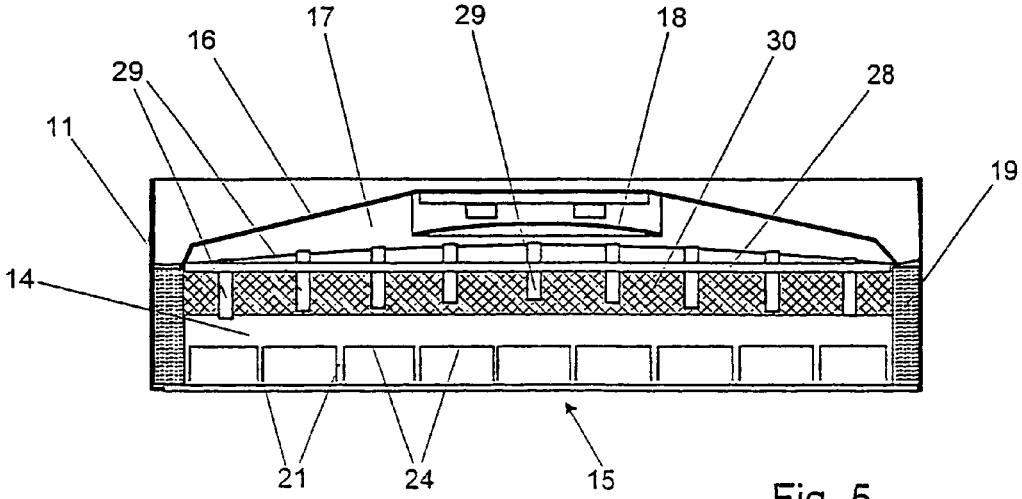
FIG. 5 is a cross-sectional view through the housing of an emitter whose radiant element is built up from individual strips according to the present invention.

A particularly advantageous embodiment of an emitter is illustrated in FIG. 5. In this embodiment, radiant element 15 is built up from a plurality of strips 24 arranged at a distance from one another which, like tubes 22 in FIG. 4, are arranged parallel to the barrier and at their ends are mounted in the frame of housing 11. In all the embodiments described in the following text, the strips are constructed and arranged in such a way that parts thereof form baffle surfaces for the flames.

Figure 6:
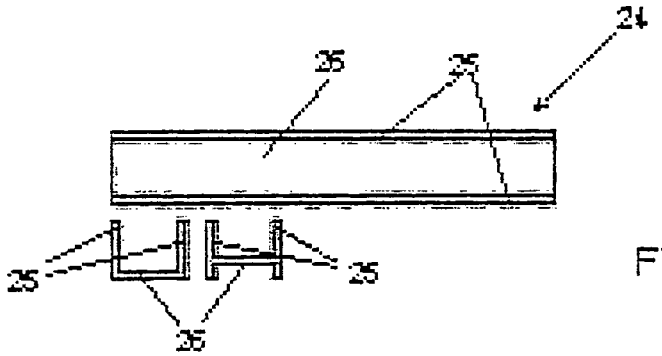
FIGS. 6–12 are plan views and/or cross-sections through variously configured and arranged strips according to different embodiments of the present invention.
Figure 7:
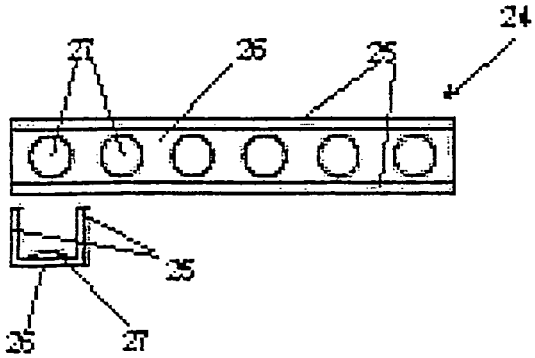

In the exemplary embodiment illustrated in FIGS. 6 and 7, strips 24 have a U-shaped or H-shaped cross-section, the open sides being oriented outward between the two legs 25 (downward in FIG. 5). The transverse webs 26 between legs 25 bound combustion chamber 14 and form the baffle surfaces for the flames. When used with the construction of the barrier described in the following text, the baffle surface effects the maximum convective heat transfer from the flames to radiant element 15. For this purpose, the transverse webs 26 of strips 24 have indentations 27 which are preferably oriented counter to the flames, as illustrated in FIG. 7. Indentations 27 act as enlarged baffle surfaces intercepting the flames. Between two strips 24 in each case there are arranged slot-like openings 23, which permit the combustion waste gases to be led away. Each strip 24 is fabricated from the highly heat-resistant material described above, which contains more than 50% by weight of $MoSi_2$ or $WSi_2$ as its main constituent.

In FIGS. 8–12, preferred embodiments are illustrated in cross-section, in which the radiant element is built up from at least two layers of strips 24 located above one another. In operation, strips 24 of the two layers assume different emission temperatures, which increases the efficiency considerably. In FIGS. 8–12, the flames are oriented from top to bottom, just as in FIGS. 1–5.

Figure 8:
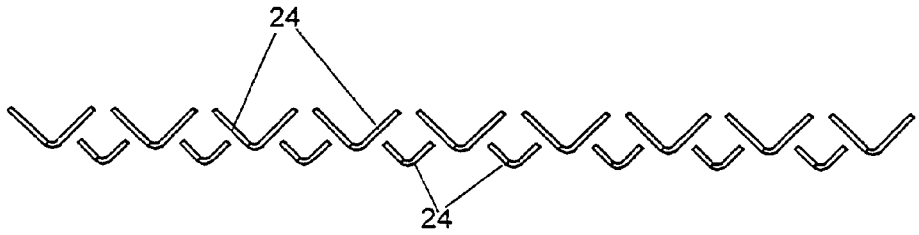
Figure 9:
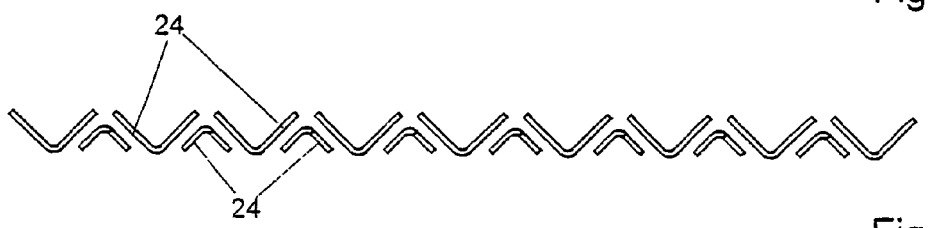
Figure 10:
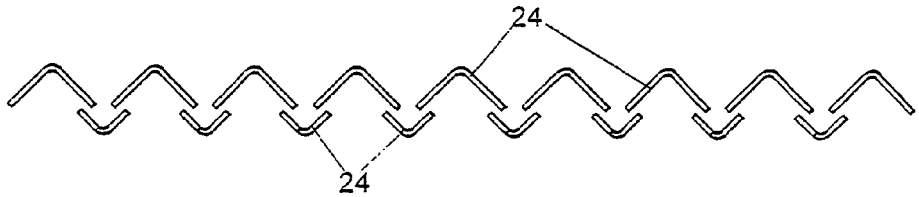

In the radiant elements according to FIGS. 8–10, strips 24 are in each case configured as angled profiles having two legs. The two legs form an angle of between 30° and 150° with respect to each other, preferably around 90°. Strips 24 of the two layers are arranged offset from one another, so that the combustion waste gases are additionally deflected as they pass through the two layers. The deflection effects a considerably improved heat transfer to the two layers. In the embodiment according to FIG. 8, the angled profiled strips of the two layers are oriented in the same direction in the flame direction and arranged offset from one another; in the embodiment according to FIG. 9, they are oriented in opposite directions to one another. In both embodiments, the flames impinge in the angle of strips 24 of the upper layer. In the arrangement according to FIG. 10, the strips are likewise arranged in opposite directions and offset from one another, the flames impinging on the angled side of the strips of the lower layer.

Figure 11:
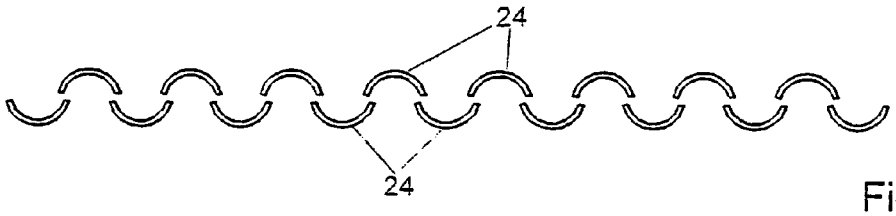

FIG. 11 illustrates an embodiment in which radiant element 15 is built up from strips 24 which are each configured in the form of a half shell. The half-shell strips 24 are in each case aligned in opposite directions in the two layers and are arranged offset from one another, so that the combustion waste gases are very largely deflected in this embodiment too.

Figure 12:
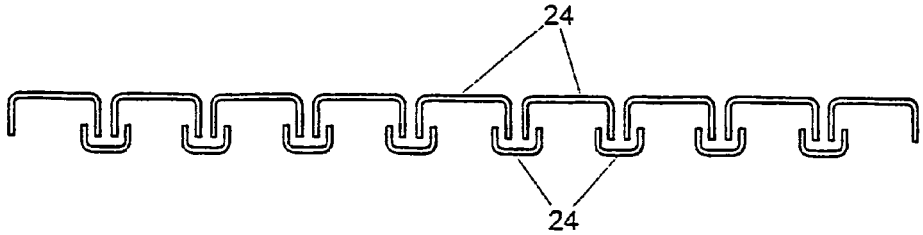

In FIG. 12, strips 24, as in the embodiment according to FIG. 5, have a U-shaped cross section. They are likewise arranged in two layers, strips 24 of the lower layer in each case being arranged in opposite directions and offset from strips 24 of the upper layer. In this way, strips 24 of the lower layer cover the interspace between two strips 24 of the upper layer and thus force the combustion waste gases emerging through the interspaces to make a direction change through 180°.

In FIG. 5, a particularly advantageous embodiment of the barrier is illustrated, which can also be used in conjunction with the radiant elements 15 illustrated in other figures instead of ceramic burner plate 12. The barrier includes a jet plate 28 made of a heat-resistant metal, into which a row of tubular jets 29, which are likewise fabricated from metal, are inserted. The gas-air mixture emerges from distribution chamber 17 into combustion chamber 14 through jets 29. In this case, jets 29 are arranged in such a way that the outlet opening of each jet 29 is aimed toward baffle surfaces formed by parts of radiant element 15. In the exemplary embodiment according to FIG. 5, the outlet openings of jets 29 are in each case aimed approximately centrally toward the transverse web 26 of a strip 24 of radiant element 15. In the embodiment according to FIG. 7, each jet 29 is aimed toward an indentation 27 in the transverse web 26. On the side of combustion chamber 14, jets 29 are embedded in a gas permeable fibrous nonwoven 30 made of a heat resistant material. The fibrous nonwoven 30, made of highly temperature resistant ceramic fibers, acts as an insulating layer for jet plate 28 and in this way prevents the latter being damaged by the high temperatures in combustion chamber 14. The diameter of a jet 29 is 1.5 mm–4 mm. As compared with ceramic burner plate 12 shown in FIG. 1, jet plate 28 contains comparatively few passage openings for the gas-air mixture. There are about 1500–2500 openings (jets 29) per $m^2$ of the area of jet plate 28.

Figure 13:
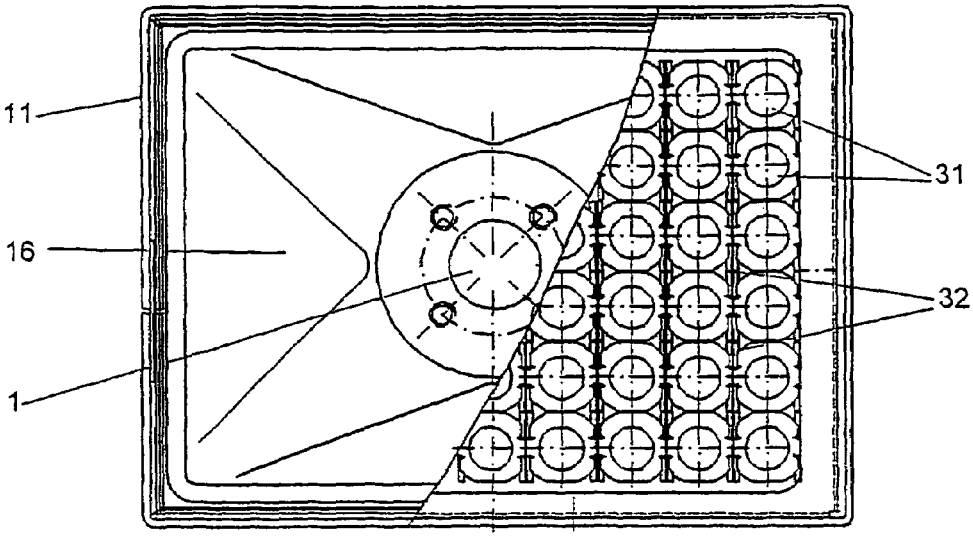
FIG. 13 is a rear side view of a further embodiment of the emitter housing, the hood of the emitter being shown partly opened.
Figure 15:
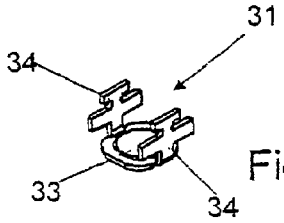
FIG. 15 is a perspective view of an individual radiating element of an radiant element according to the present invention.
Figure 14:
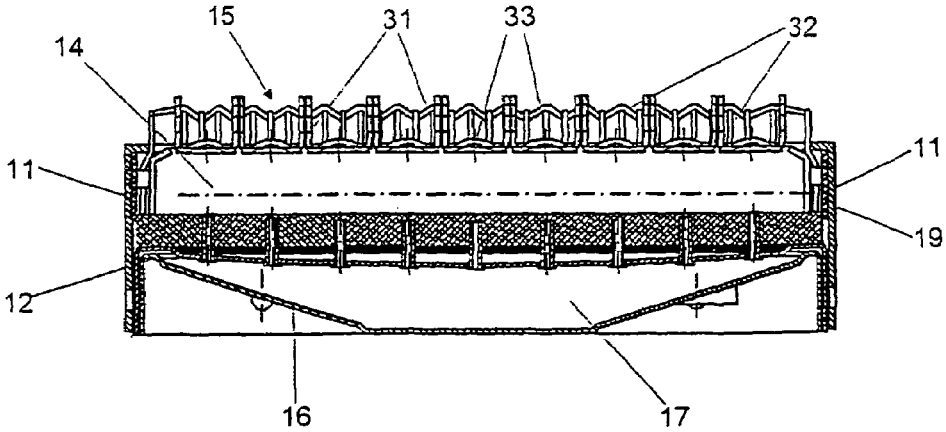
FIG. 14 is a cross-sectional view through the emitter housing of the embodiment according to FIG. 8.
Figure 16:
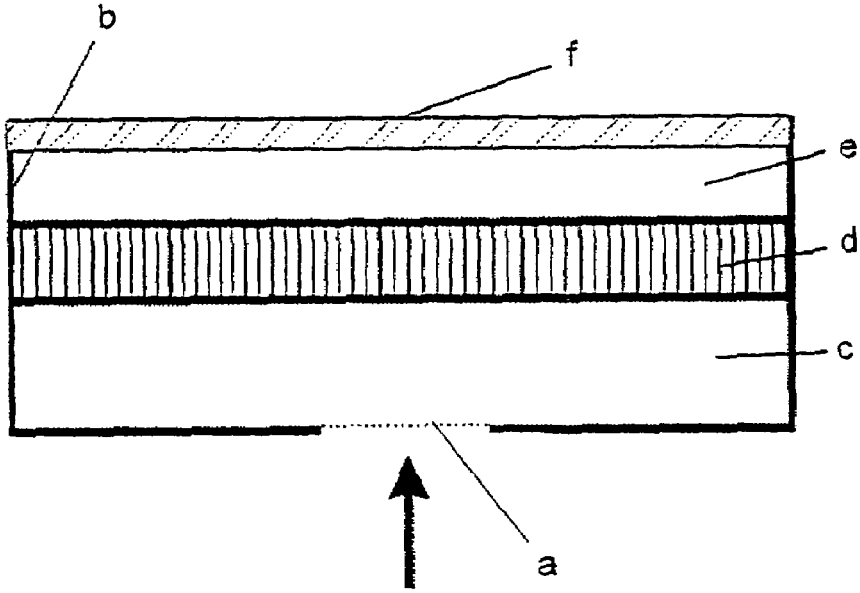
FIG. 16 is a cross-sectional view of the basic structure of an emitter housing.

FIGS. 13–16 illustrate a further embodiment of an infrared emitter according to the present invention, in which the radiant element is built up from a large number of radiating elements 31 arranged beside one another. FIG. 13 illustrates a view of the rear side of emitter housing 11, hood 16 and burner plate 12 being partly not shown, in order to permit a view of the radiant element from inside.

In this embodiment, emitter housing 11 is sealed off, on its front side emitting the infrared radiation, by a metal grid 32 made of a heat-resistant metal, into which a large number of radiating elements 31 are hooked.

Each radiating element 31 is fabricated from the highly heat-resistant material described above, which contains more than 50% by weight of $MoSi_2$ as its main constituent. It includes an approximately square panel 33 with lateral hooks 34, with which it can be hooked into grid 32. Radiating elements 21 are hooked into grid 32 in such a way that panels 33 form an impingement surface for the flames which is parallel to burner plate 12 and which is interrupted only by passage openings between the individual panels 33. The inner region of each panel 33 is preferably curved outward somewhat, in order that the impingement surface of the flames is enlarged.

Because of their possible use at very high temperatures of more than 1100° C., their high specific power density and their long service life, the infrared emitters according to the present invention are particularly suitable for drying web materials at high web speeds. One preferred area of application is the drying of moving board or paper webs in paper mills, for example downstream of coating apparatus.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An infrared emitter embodied as a planar emitter, comprising: a radiant element including a rear side and a front side, said rear side being heated by a burning fluid-air mixture, said front side emitting an infrared radiation, said radiant element being produced from a highly heat resistant material containing more than 50% by weight of a metal silicide.

2. The infrared emitter of claim 1, wherein said material contains more than 50% by weight of molybdenum disilicide ($MoSi_2$).

3. The infrared emitter of claim 1, wherein said material contains more than 50% by weight of tungsten disilicide ($WSi_2$).

4. The infrared emitter of claim 1, wherein said material contains silicon oxide ($SiO_2$) as a further constituent.

5. The infrared emitter of claim 1, wherein said material contains zirconium oxide ($ZrO_2$) as a further constituent.

6. The infrared emitter of claim 1, wherein said material contains silicon carbide (SiC) as a further constituent.

7. The infrared emitter of claim 1, wherein said radiant element includes a block which contains a plurality of continuous ducts.

8. The infrared emitter of claim 1, wherein said radiant element is built up from a row of a plurality of plates, each of said plurality of plates is arranged at a distance from an other of said plurality of plates.

9. The infrared emitter of claim 1, further including an emitter housing with a frame, said radiant element being built up from one of a plurality of tubes and a plurality of rods, each of said plurality of tubes being arranged at a distance from an other of said plurality of tubes, each of said plurality of rods being arranged at a distance from an other of said plurality of rods, either of said plurality of tubes and said plurality of rods including a plurality of ends which are fixed in said frame.

10. The infrared emitter of claim 1, wherein said radiant element is built up from a plurality of strips, each of said plurality of strips is arranged at a distance from an other of said plurality of strips, said plurality of strips include a plurality of baffle surfaces for a plurality of flames.

11. The infrared emitter of claim 10, wherein each of said plurality of strips have one of a U-shaped cross-section and a H-shaped cross-section, each of said U-shaped cross-section and said H-shaped cross-section includes a transverse web which forms at least part of said plurality of baffle surfaces, each of said U-shaped cross-section and said H-shaped cross-section includes a plurality of legs oriented outward.

12. The infrared emitter of claim 11, wherein said transverse web includes a plurality of indentations which are oriented counter to said plurality of flames.

13. The infrared emitter of claim 10, wherein each of said plurality of strips is an angled profiled strip with two legs.

14. The infrared emitter of claim 13, wherein said two legs have an angle of approximately between 30° and 150°.

15. The infrared emitter of claim 10, wherein each of said plurality of strips is configured in a form of a half shell.

16. The infrared emitter of claim 10, wherein said plurality of strips includes a plurality of layers of strips, at least one of said plurality of layers is arranged above an other of said plurality of layers, said strips of said one of said plurality of layers is arranged offset from said strips of said other of said plurality of layers.

17. The infrared emitter of claim 1, further including a housing and a grid fixed to said housing, said radiant element being built up from a plurality of individual radiating elements which are hooked into said grid.

18. The infrared emitter of claim 17, wherein said plurality of individual radiating elements at least partly have the form of a panel and are hooked into said grid in such a way that they form an impingement surface for a plurality of flames, said impingement surface is closed apart from a plurality of passage openings.

19. The infrared emitter of claim 1, further including a gas permeable barrier which bounds a combustion chamber, said gas permeable barrier including a combustion chamber side, said gas permeable barrier having a jet plate into which a row of tubular jets are inserted, said gas permeable barrier being embedded on said combustion chamber side in a gas permeable fibrous nonwoven made of a plurality of ceramic fibers.

20. The infrared emitter of claim 19, wherein said jet plate and said tubular jets are fabricated from a heat resistant metal.

21. The infrared emitter of claim 19, wherein said tubular jets include a plurality of outlet openings aimed toward a plurality of baffle surfaces formed by parts of said radiant element.

* * * * *